United States Patent [19]

Bushberger

[11] 3,963,237

[45] June 15, 1976

[54] HAND-HELD POWER CUE STICK CHALKER AND TALCUM POWDER DISPENSER

[76] Inventor: Todd E. Bushberger, 8429 W. Mitchell, West Allis, Wis. 53214

[22] Filed: Sept. 23, 1974

[21] Appl. No.: 508,298

[52] U.S. Cl. ..... 273/19; 51/170 TL; 118/242; 200/61.59; 310/81

[51] Int. Cl.[2] ..... A63D 15/16

[58] Field of Search ..... 273/17, 18, 19, 20, 273/21, 73 J; 51/58, 59 R, 170 TL, 175; 118/206, 242; 200/61.59; 222/480; 310/50, 81

[56] References Cited

UNITED STATES PATENTS

| | | | |
|---|---|---|---|
| 93,356 | 8/1869 | Shaw | 273/19 |
| 737,226 | 8/1903 | Guese | 273/19 |
| 798,914 | 9/1905 | Michaelson | 273/19 |
| 898,905 | 9/1908 | Maguire | 273/19 |
| 965,444 | 7/1910 | Dahl | 273/18 |
| 1,334,724 | 3/1920 | Tyler | 273/20 |
| 1,563,352 | 12/1925 | Fisher | 273/73 J |
| 2,079,356 | 5/1937 | Lukowski | 310/50 X |
| 2,832,514 | 4/1958 | O'Connor | 222/480 |
| 3,700,940 | 10/1972 | Sigl | 310/50 X |
| 3,781,008 | 12/1973 | Espinoza | 273/19 |

FOREIGN PATENTS OR APPLICATIONS

| | | | |
|---|---|---|---|
| 152,632 | 5/1932 | Switzerland | 273/19 |

*Primary Examiner*—Richard J. Apley
*Assistant Examiner*—Richard T. Stouffer

[57] ABSTRACT

A hand-held unit carries a cue chalk cube and includes a power source for oscillating the cue chalk cube in a substantially rectilinear path. On the other end of the hand-held unit from the cue chalk cube is situated a talcum powder dispenser. A file for dressing the cue tip is attached to the outside of the unit.

3 Claims, 3 Drawing Figures

HAND-HELD POWER CUE STICK CHALKER AND TALCUM POWDER DISPENSER

BACKGROUND OF THE INVENTION

This invention relates to the sport of billiards and, more particularly, to apparatus as used in connection with playing billiards.

Two common articles used in playing billiards are a chalk cube for chalking the tip of a cue stick and a dispenser for talcum powder which is sprinkled on the hands of the player.

In the past, various apparatus have been proposed in an attempt to provide a powered cue stick chalker. Also, various talcum powder dispenser arrangements have been proposed. Examples of prior structures disclosed in the patent art are found in U.S. Pat. Nos. 673,094, 737,226, 798,914, 1,273,219, 1,571,211, and 3,131,933 and German Letters Patent 82,890.

The various prior proposals, of which the above referred to patented structures are examples, have not been completely satisfactory. They have lacked the portability and easy manipulation which such a unit should have. They have not been completely self-contained both from the standpoint of incorporating a power source for the cue chalker and/or a dispenser for the talcum powder. Also, they have not been particularly reliable in their operation.

This invention is concerned with these problems and has among its general objects the provision of a self-contained, powered cue stick chalker which drives the cue chalk cube in a manner best suited for effectively chalking the cue stick and, moreover, a unit of that type which may also include, as an integral part thereof, a talcum powder dispenser and/or a file for dressing the cue tip.

SUMMARY OF THE INVENTION

For the achievement of those and other objects, this invention proposes a unit which can be hand-held and incorporates a cue chalk cube support, an oscillating drive for that support, and a battery source for powering the drive, all contained within the unit.

Preferably, the unit also includes a talcum powder dispenser which can be used at the option of the player.

In a preferred configuration, the unit is generally elongated with the cue chalk cube being accessible at one axial end and the talcum powder dispenser being located at the opposite axial end. Moreover, a specific preferred construction is contemplated wherein engagement of the cue chalk cube with the end of the cue stick energizes the oscillating drive so that on and off operation of the unit is automatic as it is manipulated for its intended use.

It is often desirable to shape, or smooth, the tip of the cue stick prior to chalking. To that end the preferred embodiment also includes a file carried on the outside of the unit for such use.

Other objects and advantages will be pointed out in, or be apparent from, the specification and claims, as will obvious modifications of the embodiment shown in the drawings, in which:

Figure 1:
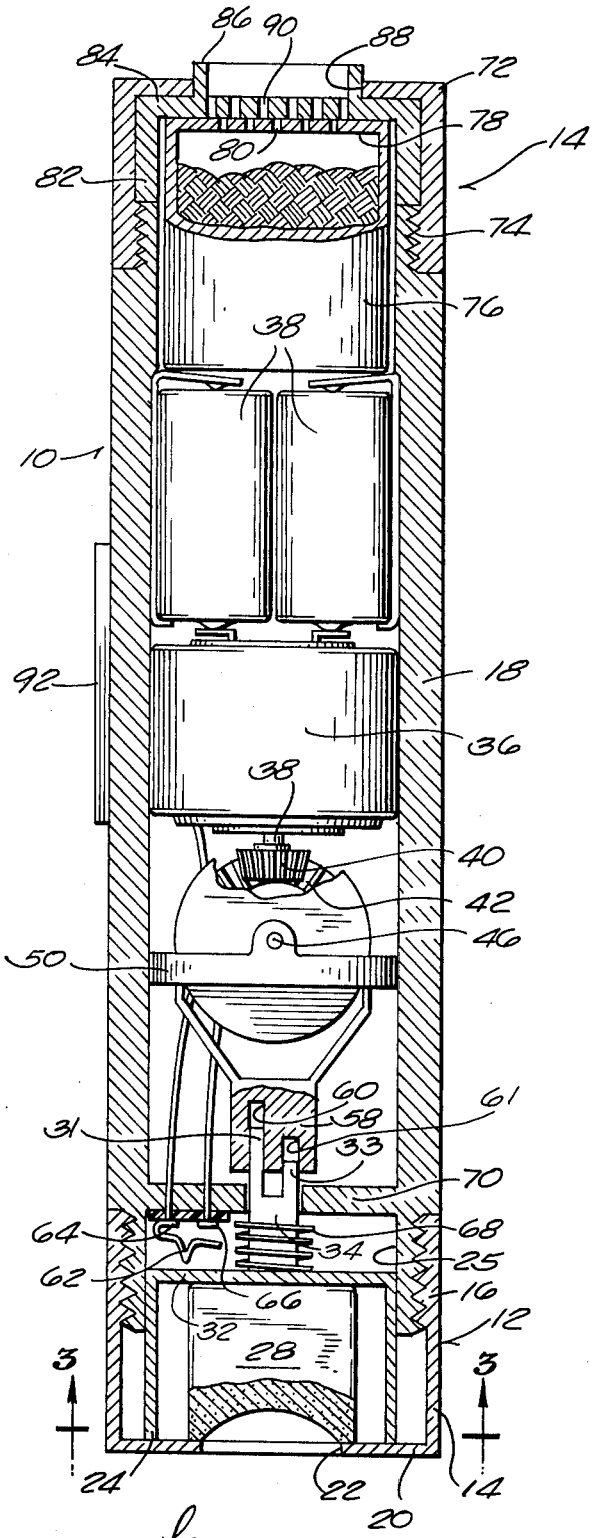
FIG. 1 is an axial section through a preferred embodiment of the invention.
Figure 2:
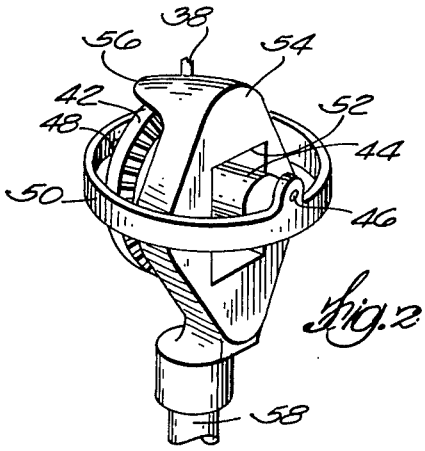
FIG. 2 is a perspective view of the oscillating drive for the cue chalk cube.
Figure 3:
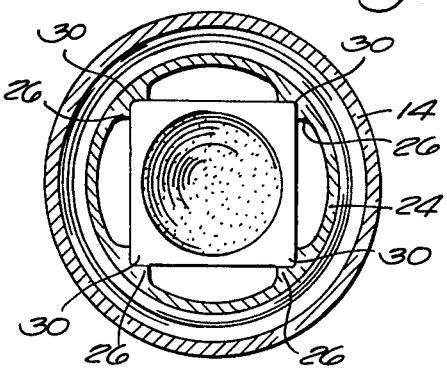
FIG. 3 is a section view taken generally along line 2—2 of FIG. 1.

With particular reference to the drawings, the unit is generally elongated consisting of a main, tubular housing 10. The unit has a cue chalk end 12 and a talcum powder dispenser end 14.

With reference to the cue chalk end 12, cap 14 has a screw connection 16 to one end of central body portion 18 of the unit. The outer, or free end 20 of cap 14, as viewed in the drawings, has a centrally located circular hole 22.

A cue chalk holder 24 is located within cap 14. The cue chalk holder is generally circular in transverse cross section to conform to the configuration of the interior of cap 14 and includes four equally spaced notched retainer ribs 26 on its interior surface. The retainer ribs extend substantially the entire axial length of holder 24. The holder has a loose running fit with wall 25 of body 18 so as to be held generally in axial alignment but to be capable of oscillating movement.

A conventional cue chalk 28 is in the form of a cube and notched retainer ribs 26 are spaced on the holder so as to receive the corners 30 of the cue chalk cube. Holder 24 includes an inner wall 32 and a drive projection 34, the function of the drive projection 34 will be explained more completely hereinafter. As can be seen in FIG. 1, with this arrangement, the cue chalk holder 24 is positively held within cap 14 but is free to move relative to that cap both in an axial and an oscillating manner as will now be described.

A motor 36 is located within central body portion 18 and is powered by a plurality of batteries 38 in a conventional manner. The electrical connections and battery support are conventional and hence not shown in detail.

Similarly, the arrangement for translating the rotary output of motor 36 into oscillating motion of the output member 58 is conventional, the details of that arrangement form no part of this invention and hence only the following general description should suffice for an understanding of the preferred embodiment.

The motor includes an output shaft 38 which carries a drive pinion 40 that engages with a circular bevel gear 42. A stub shaft 44 is connected to and is rotatable with bevel gear 42, the shaft and bevel gear being supported for rotation on pins 46 and 48 which are mounted in a retaining ring 50. Shaft 44 is eccentrically mounted on pins 46 and 48 and projects into a rectangular opening 52 in yoke 54. Yoke 54 includes a projection 56 which is mounted on, but not driven by, shaft 38. The connection between projection 56 and shaft 38 is such that the projection is free to move relative to the shaft and will not rotate as the shaft rotates. The cross section of rectangular opening 52 is generally equal to (slight clearance being provided for smooth running) the diameter of shaft 44. The shaft being eccentrically mounted, when it is rotated by bevel gear 42, in response to driven movement of pinion 40, it will cause yoke 54 to oscillate back and forth a distance equal to twice the difference between shaft 46 and that point on the diameter of the shaft furthest from pins 46 and 48. This in turn imparts an oscillating motion to drive member 58 which is part of the yoke, being either cast integrally with or attached to the yoke.

Drive projection 58 of the yoke includes axial openings 60 and 61 which mate with fingers 31 and 33 of projection 34. The connection between openings 60 and 61 and fingers 31 and 33 is such that the oscillatory motion of the projection is transmitted to the retainer thereby imparting oscillatory, arcuate movement to cue chalk cube 28.

With this arrangement, when motor 36 is energized, the end of a cue stick can be inserted through opening 22 for engagement with cue chalk cube 28 and the cube will oscillate back and forth in a substantially rectilinear path to transfer chalk to the tip of the cue. The oscillatory motion is preferred, as compared to a pure 360° rotary motion, as more effective chalking of the cue stick tip occurs with oscillatory motion.

So that oscillation of the chalk cue will occur automatically in response to insertion of the cue stick through opening 22, a switch arrangement is provided in association with holder 24 to control on-off operation of the motor.

More specifically, switch blade 62 is connected to a terminal 64 which is in turn connected to one side of the electrical source, i.e. batteries 38. A second terminal 66 is electrically connected to the other side of the electrical source thereby defining, with switch blade 62 a normally open circuit. Projection 34 on holder 24 fits into openings 60 and 61 with allowance being provided to permit limited axial movement of the projection in those openings. Compression spring 68 is seated between inner wall 32 of the holder and a fixed wall 70 and normally biases holder 24 into engagement with the free end 20 of cap 14. Upon insertion of a cue stick into the chalk cube 28, the holder is moved axially inward such that the bottom wall 32 engages leaf spring 62 moving it into engagement with contact 66 closing the circuit to the power source and energizing motor 36. When the cue stick is removed, the retainer returns to its normal position and again the switch blade 62 moves away from contact 66 opening the circuit.

The talcum dispenser portion includes a cap member 72 which has a threaded connection 74 with central body portion 18. A talcum storage container 76 fits within the cap and a portion of the central body portion and includes a wall 78 provided with a plurality of perforations 80 detachably connected in the storage container. Talcum powder is stored within container 76. A selectively rotatable cover 82 includes an annular flange 84 which is held between container 76 and cap 72 when the cap is screwed onto the central body portion but is still free to rotate generally about the longitudinal axis of the unit. An annular wall 86 projects through an opening 88 in cap 72 to provide a finger portion which can be manipulated to rotate ring 82. Within the confines of annular ring 86, the wall of ring 82 includes a plurality of perforations 90. Normally, the perforations are out of alignment as viewed in FIG. 1. When talcum powder is to be dispensed, ring 82 is rotated to bring its perforations 90 into register with perforations 80 whereupon the unit can be shaken and talcum powder dispensed into the player's hand.

A file 92 is connected to the outside of body 18 and is used to dress the cue tip, i.e. round or smooth the edges.

Although but one embodiment of the present invention has been illustrated and described, it will be apparent to those skilled in the art that various changes and modifications may be made therein without departing from the spirit of the invention or from the scope of the appended claims.

I claim:

1. Apparatus of the type described comprising, in combination, an elongated, generally tubular body having a longitudinal axis and opposite axial ends, means defining a first opening in one of said axial ends of said body;

means for supporting a chalk cube in said body at said first opening, drive means in said body spaced along said axis from said chalk cube and connected to said chalk cube for oscillating said chalk cube through a prescribed arc which forms a substantially rectilinear path in a plane generally perpendicular to said axis so that cue chalk is transferred to the end of a cue stick engaged with the chalk cube, an electric battery arrangement in said body connected to and supplying the power source for said drive means, means defining a second opening in said body spaced longitudinally on said body from said first opening, means at said second opening defining a chamber for storage of talcum powder and including means for selectively opening and closing said second opening for selectively dispensing talcum powder from said chamber, said means for supporting said chalk cube being further operative to support said chalk cube for movement in an axial direction and generally perpendicular to the plane of oscillatory movement of the chalk cube, and switch means in said body associated with said chalk cube, connected in the electrical circuit of said battery arrangement and said drive means, and responsive to movement of said chalk cube in said axial direction in response to cue stick engagement with and disengagement from the chalk cube to complete and open the electrical circuit to said battery source.

2. The apparatus of claim 1 wherein said second opening is disposed at the other of said axial ends.

3. The apparatus of claim 1 including file means attached to the outside of said elongated body.

* * * * *